US005860831A

United States Patent [19]

Röder et al.

[11] Patent Number: 5,860,831

[45] Date of Patent: Jan. 19, 1999

[54] FLAT/ROUND CABLE CONNECTING DEVICE

[75] Inventors: Jürgen Röder, Darmstadt; Manfred Lange, Königstein, both of Germany

[73] Assignee: Thomas & Betts Corporation, Memphis, Tenn.

[21] Appl. No.: 514,708

[22] Filed: Aug. 14, 1995

[51] Int. Cl.[6] ..... H01R 4/24

[52] U.S. Cl. ..... 439/422; 439/424

[58] Field of Search ..... 439/421, 422, 439/423, 424

[56] References Cited

U.S. PATENT DOCUMENTS

| | | | |
|---|---|---|---|
| 2,908,887 | 10/1959 | Broske | 439/424 |
| 3,197,729 | 7/1965 | Sarazen | 439/422 |
| 3,950,070 | 4/1976 | Groft et al. | 439/422 |
| 4,065,199 | 12/1977 | Andre et al. | 439/422 |
| 4,082,402 | 4/1978 | Kinkaid et al. | 439/422 |
| 4,277,124 | 7/1981 | Loose et al. | 439/421 |
| 4,411,484 | 10/1983 | Casey | 439/422 |
| 4,749,368 | 6/1988 | Mouissie | 439/421 |
| 4,784,623 | 11/1988 | Beck, Jr. | 439/422 |
| 5,137,468 | 8/1992 | Murakami | 439/422 |
| 5,389,741 | 2/1995 | Ueno | 439/422 |

FOREIGN PATENT DOCUMENTS

| | | | |
|---|---|---|---|
| A-0 333 039 | 9/1989 | European Pat. Off. | 439/883 |
| A-0 371 310 | 6/1990 | European Pat. Off. | 439/876 |
| A-63 269 465 | 11/1988 | Japan | 439/492 |

*Primary Examiner*—David Pirlot
*Assistant Examiner*—Tho D. Ta
*Attorney, Agent, or Firm*—Michael L. Hoelter; Salvatore J. Abbruzzese

[57] ABSTRACT

The flat/round connecting device provides connection between conductors of a flat-ribbon, flat-conductor cable having at least two flat conductors and the round conductors of a round cable having at least two round conductors. The device comprises a plurality of individual connectors, each having two portions extending along a straight line or disposed at an angle of 90° relative to each other. One of the portions has a flat conductor crimping zone with crimping tongues arranged at a mutual spacing for crimping to the flat conductors and the other portion has a round-conductor crimping zone with crimping tongues arranged at a mutual spacing for crimping to the round conductors and to the insulation of the round conductors.

6 Claims, 2 Drawing Sheets

FLAT/ROUND CABLE CONNECTING DEVICE

FIELD OF THE INVENTION

The invention concerns a flat/round cable connecting device for connecting the flat conductors of a flat-ribbon, flat-conductor cable having at least two flat conductors to the round conductors of a round cable having at least two round conductors.

BACKGROUND OF THE INVENTION

There are a number of procedures for connecting the individual wires or conductors of electric cables. In accordance with one procedure the conductors are soldered together while another procedure provides that they are crimped together. Metal connectors essentially comprise two portions which are connected together by a transition and of which one portion has a flat-conductor crimping zone and the other portion has a round-conductor crimping zone. In one embodiment the transition is of such a shape that the two crimping zones include an angle to each other, preferably 90°. At least two crimping tongues are disposed in each crimping zone. The crimping tongues are pressed onto the conductors, pushed through them and/or crimped around them. Increasingly smaller or thinner flat and round conductors are used in the course of miniaturization or because an increasing number of electric conductors have to be disposed in the same space. Therefore, when multi-conductor cables are being connected, the dimensions of the connectors also decrease therewith. Accordingly, when using the crimping procedure, the spacing between the individual connectors is also more and more reduced. There is a corresponding reduction also in the distance between the crimping zones of the connectors used for connecting the various conductors. Finally, the crimping zones with their crimping tongues are so close together that the air gaps or clearances between them become too small and leakage currents begin to flow.

SUMMARY OF THE INVENTION

The invention is concerned with connecting devices having a plurality of individual connectors, which devices are designed for crimping procedure.

The object of the present invention is so to design a connecting device that even flat-ribbon flat-conductor cables involving a smaller pitch dimension or a smaller spacing from one flat conductor to another and with smaller flat-conductor cross-sections that hitherto can be connected to each other or to a round-conductor cable.

In a connector of the general kind set forth in the opening part of this specification, that object is achieved in accordance with the invention in a surprisingly simple manner in that the crimping tongues provided for the flat conductors of the individual connectors are in mutually displaced relationship.

For the purposes of connecting a multi-conductor flat-ribbon flat-conductor cable to another multi-conductor flat-ribbon flat-conductor or round-conductor cable, the manufacturers must produce the individual connectors in that way, and the user or the person making the connection must fit the flat-conductors, in displaced relationship in the longitudinal direction, in such a way that the crimping tongues of respectively adjacent connectors are aligned with gaps between other crimping tongues. Although the individual flat conductors and therewith also the flat-conductor crimping zones of the individual connectors are only at a small spacing from each other, the crimping tongues are sufficiently far apart to prevent leakage currents. In that respect it is to be borne in mind that the crimping tongues are disposed at the mutually adjacent longitudinal sides of the flat-conductor crimping zones and are of a considerable gauge or thickness. Accordingly they are those parts of a flat-conductor crimping zone which, by virtue of the length and shape thereof, are at the smallest spacing relative to an adjacent flat-conductor crimping zone.

The invention permits the satisfactory connection of flat-ribbon flat-conductor cables with a spacing between longitudinal center lines of down to a minimum of 1.27 mm between the individual flat conductors. It was hitherto not possible for such flat-ribbon flat-conductor cable to be connected together by way of the crimping procedure.

It is recommended that the center-to-center spacing between two crimping tongues disposed on one side of a flat conductor is equal to the center-to-center spacing between two round conductors.

Advantageously, the crimping tongues provided for a flat conductor, as viewed in the longitudinal direction of the flat conductors, are displaced with respect to the crimping tongues of an adjacent flat conductor by the center-to-center spacing between two crimping tongues.

In a desirable configuration, two outer and two inner crimping tongues are provided for each flat conductor. As, in accordance with the invention, the crimping tongues are sufficiently far apart, the crimping tongues of adjacent flat conductors are sufficiently far apart, even when using four crimping tongues for each flat conductor. A total of four crimping tongues for each flat conductor. A total of four crimping tongues per flat conductor afford a higher level of mechanical strength and low electrical transition resistances.

The invention is described hereinafter with reference to example of a flat/round cable connecting device with which a four-conductor flat-ribbon flat-conductor cable is connected to a four-conductor round cable and in which the two cables include an angle of 90°.

DETAILED DESCRIPTION OF THE PREFERRED EMBODIMENT

Figure 1:
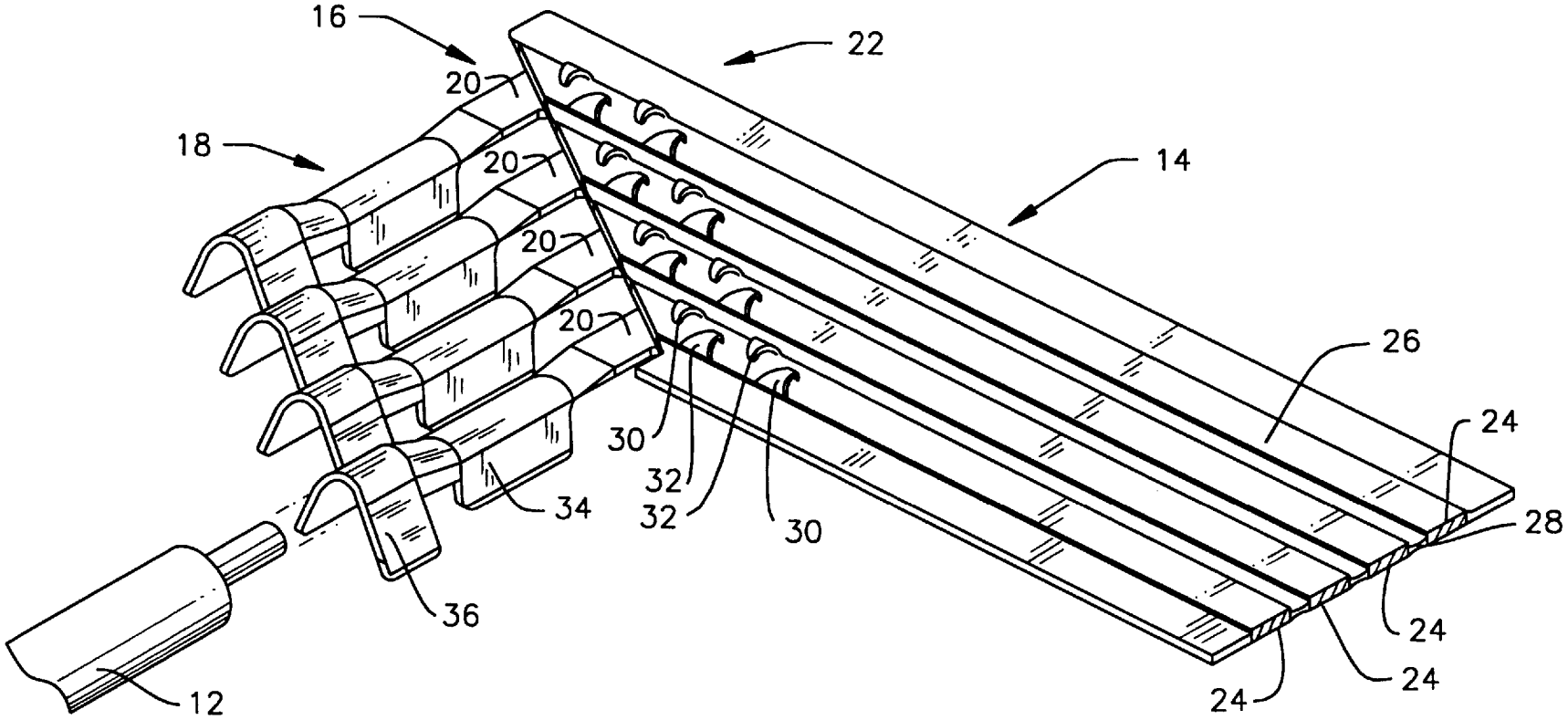
FIG. 1 is a perspective view of a flat/round cable connecting device of the present invention.
Figure 2:
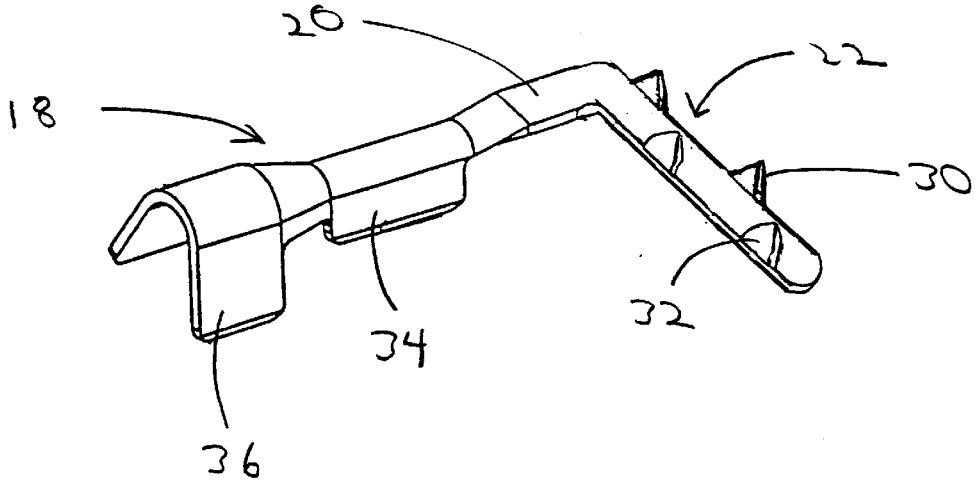
FIG. 2 is a perspective view of an individual connector of FIG. 1.

With reference to FIGS. 1 and 2 numeral 12 indicates a round conductor which is shown diagrammatically. Four such round conductors 12 form the four-conductor round cable. The four-conductor flat-ribbon flat-conductor cable which is shown in detail is indicated by reference numeral 14. The connecting device which is disposed between them and which connects them is identified by reference numeral 16. In the final condition the connector portions are disposed in an insulating body. This is not shown for the sake of enhanced clarity of illustrating the invention. Because four round conductors 12 are connected to four flat conductors, the connecting device 16 comprises four individual connectors which are identical to each other. Each of those connectors has a round-conductor crimping zone 18, a flat-conductor crimping zone 22 and a transitional portion or transition 20. The latter is of such a configuration that the four-conductor round cable and the flat-ribbon flat-conductor cable 14 include an angle of 90° to each other. The four flat conductors 24 are enclosed in insulation 26. Between the individual flat conductors 24, the insulation forms webs or lands 28. In the flat-conductor crimping zone or zones 22, two outer crimping tongues 30 and two inner crimping tongues 32 are associated with each flat conductor 24. In the round-conductor crimping zone or zones 18, associated with each round conductor are two crimping tongues 34 for the round conductor itself and two crimping tongues 36 for insulation.

For the above-described example, four individual connectors 16 are required and produced by the manufacturer. The user or the person making up the connection fits it to the four round conductors 12 and the four-conductor flat-ribbon flat-conductor cable 14 in such a way as to produce the configuration shown in the drawing. The crimping tongues 32 and 30 are pushed through the flat conductor 24 and crimped, which is not shown. Then, the connectors 16 are enclosed in an insulating body, but this is not part of the subject-matter of the invention.

The drawing shows that the inner crimping tongue 32 of a flat conductor 24 and an outer crimping tongue 30 of an adjacent flat conductor 24, which both adjoin the same web portion or land 28, are disposed apart by a diagonal. The diagonal is longer than the spacing by which those crimping tongues would be disposed apart if they were to be arranged in the same transverse plane, as in the state of the art.

The preferred embodiment described herein is intended to be illustrative rather than limiting, the true scope of the invention being set forth in the claims attached hereto.

We claim:

1. A flat/round cable connecting device for connecting conductors of a flat-ribbon flat-conductor cable having at least two flat conductors;

comprising a plurality of individual connectors each having first and second portions disposed at an angle of 90° relative to each other, the first portion of each connector having a round-conductor crimping zone with crimping tongues arranged at a mutual spacing for crimping to a round conductor, the second portion of each connector having crimping tongues in mutually displaced relationship that are electrically engagable with one of the flat conductors, said plurality of connectors being disposed on said flat-ribbon cable at spaced distances along a longitudinal direction thereof, such that the round conductors may be coupled to the ribbon cable independent of a pitch distance of the conductors of the ribbon cable.

2. A flat/round cable connecting assembly for connecting conductors of a flat-ribbon cable having at least two flat conductors comprising:

a plurality of connectors, each connector having a first and a second portion formed at substantially right angles to each other, said first portion having means for engaging and electrically coupling with a round conductor cable, said second portion having means for engaging and electrically coupling with one of said flat conductors, said plurality of connectors being disposed on said flat-ribbon cable at spaced distances along a longitudinal direction thereof, such that round conductors may be coupled to said ribbon cable independent of a pitch distance of the conductors of said flat ribbon cable.

3. A flat/round cable connecting assembly as defined in claim 2, wherein said means for engaging and electrically coupling with said flat conductor includes a plurality of flat conductor crimping tongues spaced along said second portion.

4. A flat/round cable connecting assembly as defined in claim 3, wherein said means for engaging and electrically coupling with said round conductor cable includes a crimping zone having a plurality of mutually spaced round conductor crimping tongues for crimping said connector to said round conductor cable.

5. A flat/round cable connecting assembly as defined in claim 4, wherein said flat conductor crimping tongues include a pair of spaced inner crimping tongues and a pair of spaced outer crimping tongues, wherein said inner crimping tongues are offset from said outer crimping tongues in a longitudinal direction along said second portion of each connector.

6. A flat/round cable connecting device as defined in claim 5, wherein said spaced distance between each said connectors is substantially equivalent to said space between said outer crimping tongues.

* * * * *